US006006860A

United States Patent [19]

Bell

[11] Patent Number: 6,006,860

[45] Date of Patent: Dec. 28, 1999

[54] SAFETY HARNESS OR BELT WITH FIBER MEANS TO INDICATE SHOCK LOADING

[76] Inventor: Michael Bell, 1705 Triumphe Way, Warrington, Pa. 18976

[21] Appl. No.: 08/326,802

[22] Filed: Oct. 20, 1994

Related U.S. Application Data

[63] Continuation of application No. 08/149,863, Nov. 10, 1993, abandoned.

[51] Int. Cl.[6] ..... A62B 35/00

[52] U.S. Cl. ..... 182/18; 182/3

[58] Field of Search ..... 182/18, 3; 280/805; 244/151 R

[56] References Cited

U.S. PATENT DOCUMENTS

| | | | |
|---|---|---|---|
| 2,294,897 | 9/1942 | Ellis . | |
| 2,428,559 | 10/1947 | Ellis . | |
| 2,613,865 | 10/1952 | Rose . | |
| 3,025,995 | 3/1962 | Koelsch et al. . | |
| 3,444,957 | 5/1969 | Ervin, Jr. . | |
| 3,801,340 | 4/1974 | Ellis . | |
| 3,804,698 | 4/1974 | Kinloch . | |
| 4,253,544 | 3/1981 | Dalmaso | 182/3 |
| 4,446,944 | 5/1984 | Forrest et al. . | |
| 4,538,702 | 9/1985 | Wolner . | |
| 4,662,487 | 5/1987 | Koch | 280/805 X |

FOREIGN PATENT DOCUMENTS

| | | | |
|---|---|---|---|
| 2402383 | 4/1979 | France | 182/3 |
| 2336931 | 7/1973 | Germany | 182/3 |

*Primary Examiner*—Alvin Chin-Shue
*Attorney, Agent, or Firm*—Caesar, Rivise, Bernstein, Cohen & Pokotilow, Ltd.

[57] ABSTRACT

A harness or belt to be worn by a person connected to some elevated anchor point, e.g., a rope grab on a safety line, to prevent the person from a fall. The device comprises at least one web or strap of a fabric which is subject to a shock load when the device has been used to arrest the fall of the person and plural shock load indicating strands or fibers located on the web or strap. The web or strap is a generally flat member having an exterior surface and is formed of plural interlaced strands of a first stretchable, yet strong material, e.g., nylon or polyester. The shock load indicating strands are of a contrasting color to the strands forming the strap or web and are visible from the exterior surface of the web. The shock load indicating strands are of a lesser stretchability than the strands of the web or strap. Accordingly, upon the shock loading of the harness or belt the shock load indicating strands rupture and fray out of the exterior surface of the web, whereupon the frayed ends are readily visible. This appearance indicates that the device has been used to arrest a fall and should be discarded or refurbished.

6 Claims, 2 Drawing Sheets

SAFETY HARNESS OR BELT WITH FIBER MEANS TO INDICATE SHOCK LOADING

This application is a continuation, of application Ser. No. 08/149,863, filed Nov. 10, 1993, abandoned.

BACKGROUND OF THE INVENTION

Due to the enactment of various safety laws, persons working at elevated positions, e.g., when washing the upper story windows of a building, etc., are required to be protected against falls. One common approach to achieve that end is the use of a safety belt which is worn on the worker's waist or a harness worn on the worker's torso. The belt/harness typically includes a D-ring or some other metal loop fixedly mounted on it. The D-ring is arranged to be connected, via a lanyard, to a "rope grab" device which is mounted on a safety line. The safety line typically comprises a rope, cable or other type of strong line which extends vertically from a fixed elevated anchor point downward past the point at which the worker is located. In fact in many applications the line extends all the way to the ground. The rope grab is arranged to slide along the safety line to follow the worker up or down the structure on which the worker is working. In the event that the worker should fall off of the structure the rapid downward pull on the rope grab caused by the momentum of the worker causes the rope grab to automatically immediately engage and lock itself into a fixed position on the safety line, thereby arresting the worker's fall and supporting him/her until he/she can be rescued.

Heretofore, some prior art lanyards for connecting the worker's safety belt or harness to the rope grab or to a fixed anchor point in safety systems have included some means to indicate that the lanyard has been stressed by a fall. For example, in U.S. Pat. No. 4,253,54 (Dalmaso) there is disclosed a lanyard which when stressed by a fall results in the breakage of stitching and the release of a flag to indicate that occurrence. In U.S. Pat. Nos. 2,613,865 (Rose); 3,444,957 (Ervin, Jr.); 3,804,698 (Kinloch); 4,446,944 (Forrest et al.); and 4,538,702 (Wolner) there are disclosed shock absorbing safety belts or lanyards which include looped portions which are extended when the device is stressed, such as occurs when arresting a fall.

Other devices have been described in the patent literature for indicating the existence of stress on a member. For example U.S. Pat. No. 3,025,995 (Koelsch et al) discloses a container or case having deformable corners to indicate the absorption of a shock thereto. U.S. Pat. Nos. 2,294,897 (Ellis); 2,428,559 (Ellis); and 3,801,340 (Ellis) disclose adherent brittle films used on rigid articles which crack at predetermined strain levels to indicate stress on the articles.

Some safety harnesses or belts which are commercially available have made use of fibers of a contrasting color or appearance woven into the body of the strap(s) making up the harness or belt. These fibers are not visible if the harness or belt is intact, but become visible if the harness or strap should become worn away, such as by abrasion. If such fibers become visible that indicates that the harness/belt should be replaced or refurbished.

Notwithstanding the above, the prior art has not addressed the problem of providing some indication on a safety harness or safety belt that it has been subjected to a shock caused by the operation of a rope grab or other fall prevention device connected to the belt or harness having arrested the fall of a worker wearing the belt or harness so that the belt or harness can be checked and refurbished or discarded. Thus, a need exists for such a safety harness or belt.

OBJECTS OF THE INVENTION

Accordingly, it is a general object of this invention to provide a safety belt or harness which addresses the aforementioned need.

It is a further object of this invention to provide a safety harness or belt with means for indicating that it has been used to arrest the fall of a worker.

It is a further object of this invention to provide a safety belt or harness which includes means which provide a visual indication that the belt or harness has been subjected to a load in excess of a predetermined limit, such as occurs when the safety belt or harness has been used to arrest the fall of a worker.

It is a further object of this invention to provide a safety belt or harness with means for indicating that it has been used to arrest the fall of a worker, yet which is not significantly more complex or expensive than prior art safety belts or harnesses.

SUMMARY OF THE INVENTION

These and other objects of this invention are achieved by providing a safety device, e.g., a harness or belt, arranged to be worn on the body of a person to be connected to some elevated anchor point, e.g., a rope grab on a safety line, to prevent the person from a fall.

The safety device comprises at least one web of a fabric which is subject to a shock load when the safety device has been used to arrest the fall of the person. The web of fabric is a generally flat strap having at least one visible surface, e.g., the outer surface of the web, and comprises plural strands of a first material. At least one shock indicating strand is secured on the outer surface of the web.

The strand(s) of the shock indicating material are visible from the visible surface of the web and are of lesser stretchability than the strands making up the web so that the shock indicating strands rupture upon the application of the shock load to the harness. The rupture of those strands causes them to fray and extend out of the surface of the web so that the frayed strands are readily visible, thereby indicating that the device has been used to arrest a fall.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
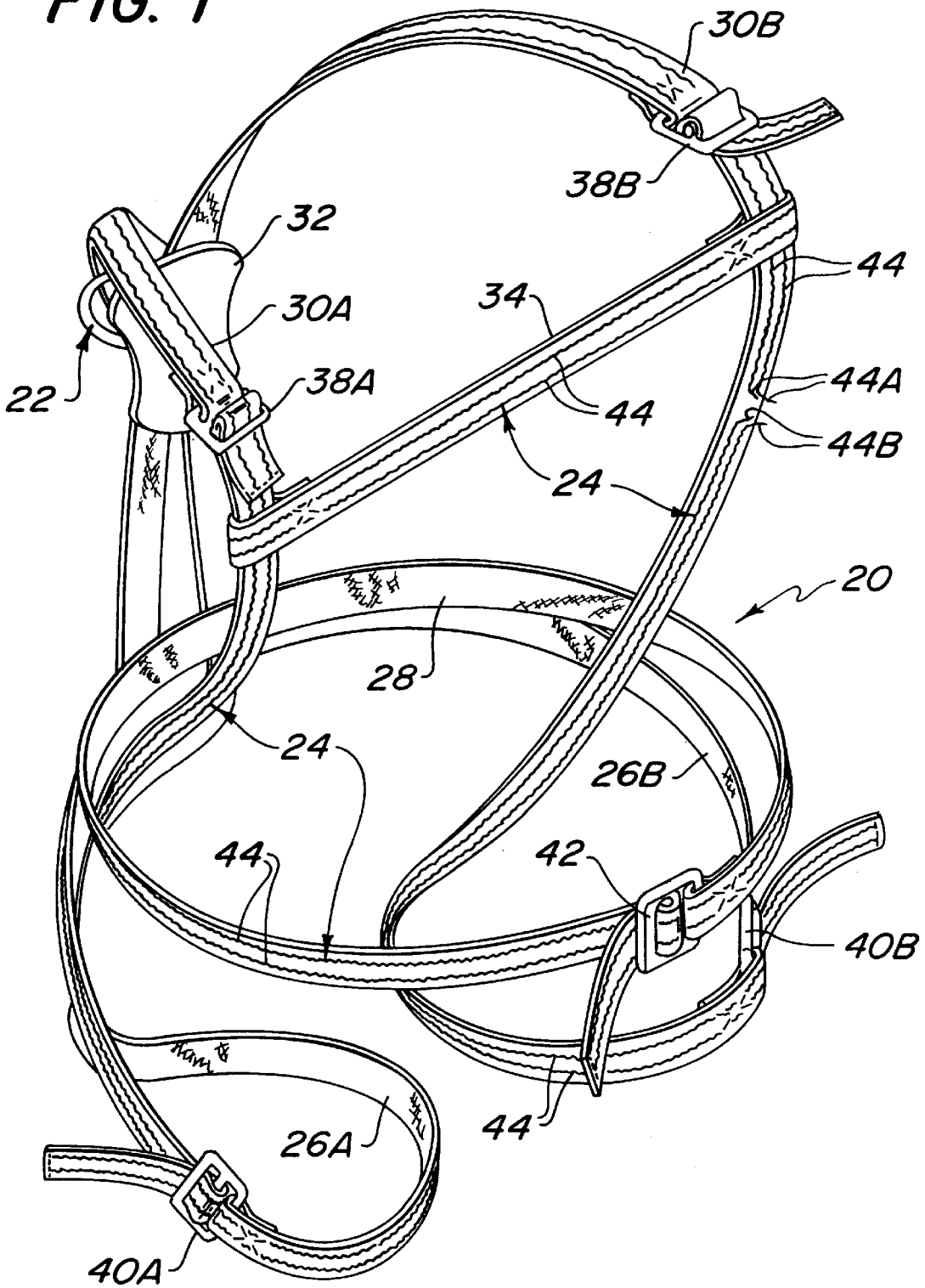
FIG. 1 is an isometric view of a typical safety harness constructed in accordance with one aspect of this invention after it has been used to arrest the fall of a person wearing it.

Referring now to various figures of the drawing where like reference numerals refer to like parts there is shown at 20 in FIG. 1, a safety harness constructed in accordance with this invention. The safety harness shown herein is merely exemplary of various types of harnesses arranged to be worn by a worker to be attached to a fixed anchor point (not shown) to thereby protect the worker from a fall. Thus, the harness may be a conventional type (such as shown herein) or may be constructed in accordance with my copending U.S. patent application Ser. No. 08/013,281, filed on Feb. 4, 1993, entitled Harness With Adjustable Positioning Pad and Tool Belt, and whose disclosure is incorporated by reference herein.

Any type of harness or safety belt can be constructed in accordance with the teachings of this invention to provide a readily visible indication that the harness/belt has been subjected to a sharply applied tensile force, which may weaken the harness/belt and render it unsafe for further use. Such sharply applied tensile forces commonly occur when the harness/belt has been used to arrest the fall of a worker.

The harness or safety belt constructed in accordance with this invention is arranged to be connected to a fall prevention device, such as a rope grab (not shown). The rope grab may be any conventional type of device or may be constructed in accordance with the teachings of my copending U.S. patent application Ser. No. 08/007,456, filed on Jan. 1, 1993, entitled Rope Grab Device Indicating The Existence Of Shock Impact On Personal Safety, whose disclosure is incorporated by reference herein. As is conventional, the rope grab is mounted on a conventional safety line (not shown) extending downward from a fixed anchor point (not shown) on an elevated structure (not shown) upon which the worker is located. The worker is connected to the rope grab via a conventional lanyard (not shown). In particular, one end of the lanyard is connected to a metal ring 22 on the harness, while the other end of the lanyard is connected to the rope grab.

In the interest of safety it is preferable that the lanyard include a shock absorber to absorb the shock when the rope grab operates to arrest the worker's fall. One particularly effective shock absorbing lanyard is sold by Descent Control, Inc. under the trademark SOFT LANDING.

Irrespective of the type of harness or safety belt employing the subject invention it includes shock load indicating means 24 which is automatically actuated to provide a visual indication that the harness/belt has been subjected to a shock load in excess of a predetermined level, such as would occur when the harness has been used to arrest the fall of a worker.

Before describing the details of the shock load indicating means a brief description of the exemplary harness shown in FIG. 1 is in order. Thus, as can be seen the harness 20 is formed of webbing or straps which are connected together. In particular the harness 20 basically comprises a pair of straps 26A and 26B which are arranged in loops to encircle the wearer's thighs, a waist belt 28 or some other portion to encircle the wearer's waist, a pair straps 30A and 30B extending over the wearer's shoulders and crossing over each other at a buckle 32 at approximately the center of the wearer's back, and a chest strap 34 connected between the chest straps 30A and 30B.

Each of the straps forming the harness is composed of high-strength fibers 36 (FIGS. 2 and 3) of plastic or other type material, such as nylon or polyester, which are woven together or otherwise interlaced to form a single ply or multiple ply web. The straps or webs are fixedly secured together, such as by stitching and various buckles (to be described hereinafter) to complete the harness. For example, an adjustable buckle 38A is provided in the chest strap 30A and a similar buckle 38B is provided in the chest strap 30B. These buckles enable those straps to be adjusted for the wearer. In a similar manner an adjustable buckle 40A is provided in the leg strap 26A and a similar buckle 40B is provided in the leg strap 26B to enable those straps to be adjusted for the wearer. An adjustable buckle 42 is provided in the waist belt or strap 28 to enable the belt to be adjusted for the wearer.

In accordance with a preferred embodiment of this invention shown in FIG. 1 each of the straps making up the harness includes the heretofore identified shock load indicating means 24. That arrangement is not mandatory. Thus, as long as the harness includes shock load indicating means 24 in at least one strap which may be subjected to tensile loading upon the use of the harness to arrest the fall of the worker, the objects of this invention will be achieved. However, as will be appreciated from the discussion to follow, the more straps which include the shock load indicating means 24, the better to ensure that a harness which has been used to arrest the fall of a worker does not slip by a visual inspection.

Figure 2:
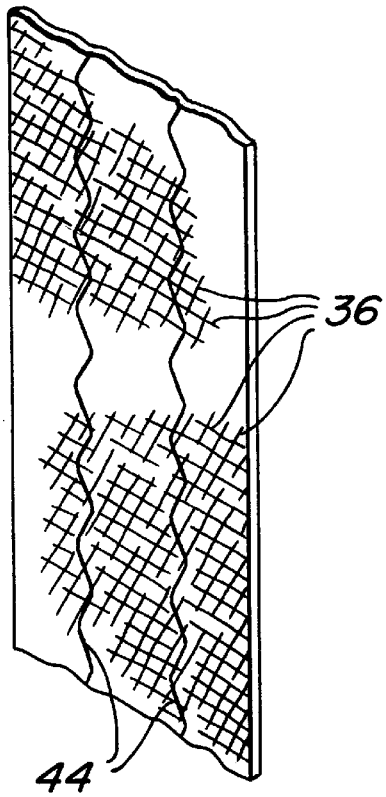
FIG. 2 is an enlarged, isometric view of a section of any strap portion of the harness shown in FIG. 1, prior to that portion being subjected to a tensile force applied thereto, such as occurs when the harness has been used to arrest the fall of a worker wearing the harness.
Figure 3:
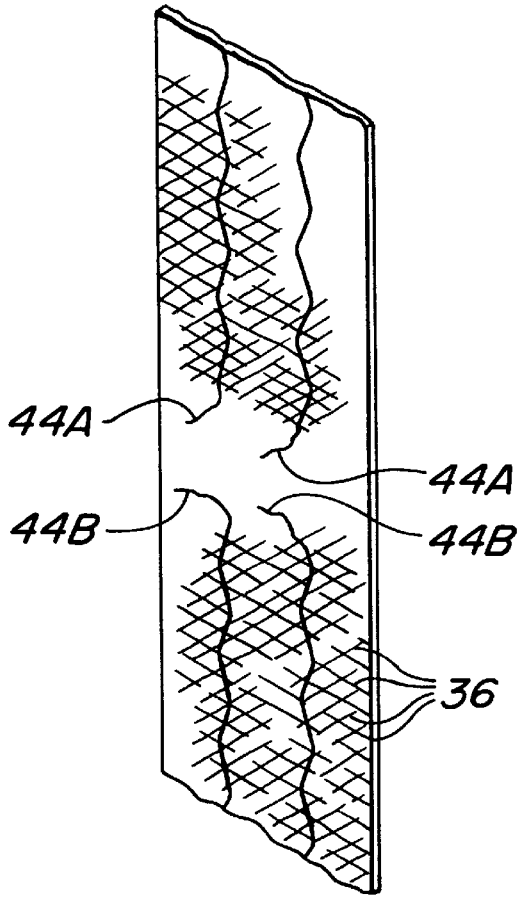
FIG. 3 is an enlarged, isometric view of the section of the strap portion shown in FIG. 3 after that portion has been subjected to a tensile force resulting from operation of the harness in arresting the fall of a worker wearing the harness.
Figure 4:
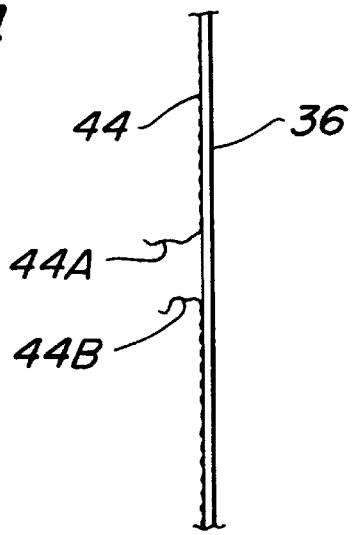
FIG. 4 is a side elevational view of the strap portion shown in FIG. 3.

The shock load indicating means 24 is best seen in FIGS. 2–4 and basically comprises a least one rupturable fiber or strand 44 located on at least the exterior surface 46 of the associated harness/belt strap. The rupturable fiber 44 may be woven or knitted into the fabric making up the strap so that it is located at the exterior surface, or may be disposed on that surface and secured thereto by any suitable means, e.g., an adhesive. In any case the shock load indicating fibers 44 are fixedly secured to the fibers 36 making up the strap and are substantially flush with the exterior surface 46 of the strap, as shown in FIG. 2.

The fibers 36 making up each strap have a high tensile strength and are somewhat stretchable so that they can stretch up to predetermined amount, e.g., 130%, without failure when subjected to a tensile load, such as would result when the harness has been used to arrest the fall of a worker wearing it. The shock load indicating fibers 44 of the indicating means 24 are constructed of any suitable strong material, e.g. the material sold under the Registered Trademark KEVLAR by E. I. DuPont de Nemours Company, having a lesser stretchability, e.g., a stretch ability of 115%, than the fibers 36 making up the harness webbing when subjected to an abrupt tensile load, such as occurs when the harness operates to arrest the fall of a worker. In particular, the shock load indicating fibers 44 are arranged to rupture when subjected to that kind of abrupt load. Thus, when the harness 20 is shock loaded in arresting the fall of a worker, the fibers 36 making up the harnesses straps will stretch, thereby stressing the fibers 44 which are secured thereto beyond their limit so that they rupture, while the fibers 36 remain intact. When the fibers 44 rupture, their ends 44A and 44B which are contiguous with the rupture point(s) fray to extend out beyond the surface of the strap, as shown in FIGS. 1, 3 and 4. The frayed ends 44A and 44B are hence readily visible to indicate that the harness has been stressed in arresting the fall of a worker.

The harness 20 may then be discarded so as not to be used again, or may be subjected to testing to see if its structural integrity has not been degraded below a safe level so that it may be reconditioned or refurbished for reuse. Such reconditioning will at a minimum require the substitution of new strap sections including intact shock indicating fibers 44.

In the interest of facilitating the inspection of a harness to determine if it has been used to arrest the fall of a worker, the fibers 44 are preferably made of a contrasting color to the fibers 36. Thus, when inspecting the harness one should be readily able to locate the shock indicating fiber(s) and to determine if it(they) have been ruptured.

It should be pointed out at this juncture that the number, location, and color of the shock indicating straps can be selected, depending upon the application and/or design goals of the designer.

Without further elaboration the foregoing will so fully illustrate my invention that others may, by applying current or future knowledge, adapt the same for use under various conditions of service.

I claim:

1. A safety device arranged to be worn on the body of a person to be connected to some elevated anchor point to protect the person from falling from an elevated position by arresting the fall of the person, whereupon said device is subjected to a fast acting shock load, said safety device comprising connector means, at least one elongated strap of a fabric, and shock load indicating means, said elongated strap of fabric comprising plural strands of a first material and which are interlaced with each other to form a generally flat web having at least one visible surface, said connector means being connected to said flat web and being arranged to be connected to an elevated anchor point, said flat web being arranged for encircling a portion of the body of the person to suspend the person from the anchor point, said shock load indicating means being incorporated in said web and comprising at least one indicator strand formed of a second material of a visually distinguishable color from said plural strands and of a first predetermined stretchability, said strands of said first material being of a second predetermined stretchability greater than said first predetermined stretchability, said at least one indicator strand being interlaced along its length to said plural strands to fixedly secure it thereto substantially flush with said visible surface to be readily visible therefrom, said at least one indicator strand being rupturable at any point along the length thereof, said fixed securement of said at least one indicator strand causing it to stretch in response to the stretching of said plural strands so that upon the occurrence of a shock load said plural strands stretch to bear substantially the full shock load at all times that shock load is applied to said safety device while said at least one indicator strand ruptures and frays out of said visible surface to be readily visible.

2. The safety device of claim 1, wherein said safety device comprises a belt.

3. The safety device of claim 1 wherein said safety device comprises a harness.

4. The safety device of claim 1 wherein said visible surface comprises an exterior surface of said device.

5. The safety device of claim 1 wherein said first material is nylon.

6. The safety device of claim 1 wherein said first material is polyester.

* * * * *